US010004936B1

(12) United States Patent
Ekstrom

(10) Patent No.: US 10,004,936 B1
(45) Date of Patent: Jun. 26, 2018

(54) MULTIFUNCTIONAL TRAINING AND WORKOUT HARNESS

(71) Applicant: Cade Ekstrom, Jacksonville, FL (US)

(72) Inventor: Cade Ekstrom, Jacksonville, FL (US)

( * ) Notice: Subject to any disclaimer, the term of this patent is extended or adjusted under 35 U.S.C. 154(b) by 0 days. days.

(21) Appl. No.: 15/381,261

(22) Filed: Dec. 16, 2016

(51) Int. Cl.

| | |
|---|---|
| ***A63B 21/00*** | (2006.01) |
| ***A45F 3/14*** | (2006.01) |
| ***A63B 21/06*** | (2006.01) |
| ***A63B 21/065*** | (2006.01) |
| *A45F 3/00* | (2006.01) |

(52) U.S. Cl.
CPC ..... *A63B 21/4007* (2015.10); *A45F 3/14* (2013.01); *A63B 21/0604* (2013.01); *A63B 21/065* (2013.01); *A45F 2003/003* (2013.01); *A45F 2003/146* (2013.01)

(58) Field of Classification Search
CPC ..... A63B 1/00; A01M 31/006
USPC ..... 224/184; 482/106–110
See application file for complete search history.

(56) References Cited

U.S. PATENT DOCUMENTS

D106,869 S * 11/1937 Miller ..... 224/259
4,280,645 A 7/1981 Goodden
4,298,149 A * 11/1981 Gottschalk ..... A45F 3/10 224/201
4,553,633 A * 11/1985 Armstrong ..... A62B 35/0037 119/857
4,600,134 A * 7/1986 Colby ..... A45F 3/04 224/260
5,060,314 A * 10/1991 Lewis ..... A62B 17/003 2/2.5
5,131,576 A * 7/1992 Turnipseed ..... A45F 3/08 224/262
D342,348 S * 12/1993 Panarelli ..... D29/101.1
5,954,250 A * 9/1999 Hall ..... A45F 3/08 224/262
6,125,475 A * 10/2000 Taylor ..... A41F 3/00 182/3
6,769,137 B2 * 8/2004 D'Annunzio ..... F41H 1/02 2/102
7,210,605 B2 * 5/2007 Willows ..... A41D 13/01 224/623
7,243,376 B2 * 7/2007 Johnson ..... F41H 1/02 2/102
7,818,818 B2 10/2010 Grilliot et al.
8,109,863 B2 2/2012 Gilberti et al.
D687,913 S * 8/2013 Garcia ..... D21/805
8,556,840 B2 * 10/2013 Burke ..... A61F 5/028 602/19
9,545,144 B2 * 1/2017 Gill ..... A45F 3/04
(Continued)

*Primary Examiner* — Brian D Nash
(74) *Attorney, Agent, or Firm* — Lawrence J. Gibney; Mitchell Ghaneie

(57) ABSTRACT

The device and its attachments include a harness that is worn over the user's upper body and around the user's waist. The harness provides a plurality of attachment areas for additional items. Some of the items include but are not limited to a log carrier, a large duffle bag, and a small duffle bag. The harness will allow said items to attach with quick release loops and side release buckles. The harness will also provide a pouch attachment ladder system (PALS) or otherwise known as a modular lightweight load-carrying equipment system (MOLLE). Accordingly, the harness may be used to carry or drag said items depending on the exercise being carried out by the user.

9 Claims, 6 Drawing Sheets

(56) References Cited

U.S. PATENT DOCUMENTS

| | | | | |
|---|---|---|---|---|
| 2009/0179057 | A1* | 7/2009 | Basye | A45F 3/047<br>224/628 |
| 2010/0243372 | A1 | 9/2010 | Wilkinson | |
| 2013/0292432 | A1* | 11/2013 | Stevens | A45F 3/04<br>224/184 |
| 2014/0001221 | A1* | 1/2014 | McDonald | A45F 3/14<br>224/637 |
| 2014/0151424 | A1* | 6/2014 | Hexels | A45F 3/06<br>224/637 |

* cited by examiner

MULTIFUNCTIONAL TRAINING AND WORKOUT HARNESS

BACKGROUND OF THE INVENTION

A. Field of the Invention

This invention relates to a multifunctional workout harness that is worn by an individual to carry an Olympic training log, and various other items on her or his back. The harness is additional capable of allowing tethers, ropes, or cables to be attached to it and other equipment for dragging or resistance training.

B. Prior Art

There are many prior art references to workout harnesses. Representative examples of this include Gilberti et al. (Gilberti) U.S. Pat. No. 8,109,863, Grilliot et al. (Grilliot) U.S. Pat. No. 7,818,818, Goodden U.S. Pat. No. 4,280,645, and Wilkinson US patent application publication 2010/0243373.

The Gilberti, Grilliot, Goodden and Wilkinson patents and patent application publication each disclose a strapping or harness device. Each disclosure teaches a shoulder strap or belt for carrying or dragging an object. The Gilberti device is distinct from the other referenced prior art because it is actually used for athletic training. The Gilberti harness provides a padded waist belt that is intended to be worn by the trainer and a rope or tether is attached to the back of the belt at one end and is attached to a weighted bag on its other end. The trainer is to run while the weighted bag drags on the ground, which is a form of resistance training. Other alternative forms of resistance training include the use of a parachute.

Grilliot teaches a harness that straps to a person with shoulder straps. The shoulder straps come over the top of the shoulder and around the person's underarm. On the back of the harness there are two loops that are intended to hold an object. Grilliot does not specifically discuss what the two loops may hold, but it seems that they are intended to hold a cylindrical tank such as a fire extinguisher.

Goodden claims a harness that is used for picking up heavy items and displaces the weight on the shoulders and back of the user. The user's hand fits inside an L-shaped support that holds the heavy items. This harness is significantly different from the presently claimed invention primarily because the presently disclosed harness provides quick attachment areas to carry items on the user's back rather than in front of the user.

Wilkinson discloses a shoulder harness for dragging individuals that are injured. Wilkinson specifically discusses dragging downed firemen to safety. This harness does not utilize a belt or buckles or quick disconnects. It is essentially comprised of three loops that. are attached to each other. Each of the two shoulder loops wrap around the rescuer's shoulders and the other shoulder loop wraps around the shoulder of the person being rescued.

No prior art provides the benefits of the present invention for securely carrying an Olympic training log, dragging the Olympic training log, and simultaneously carrying a duffle bag or other pouch that can hold water for drinking.

BRIEF SUMMARY OF THE INVENTION

This invention is intended to provide individuals with a training harness. The harness being disclosed is intended to simultaneously carry an Olympic training log amongst other items. For example, a small duffle bag can be clipped into the harness while the training log is also secured or dragged behind the user. Alternatively, the trainer could remove the training log device and small duffle bag to then attach a larger duffle bag with four points of connection to the harness.

The claimed harness will have multiple attachment points for other items to attach. Some attachment points will be quick release buckles. In addition, the harness will provide a MOLLE (modular lightweight load-carrying equipment) system. MOLLE can also be referred to as a pouch attachment ladder system also known as PALS. The system is essentially a formation of webbing which is attached to the harness that allows for other items to be easily attached.

The presently described harness is intended to carry or drag hundreds of pounds for extended periods of time and may be customizable for the wearer of the harness.

NUMBERING REFERENCE

1—Device
5—Harness
10—Modular lightweight load-carrying equipment system
15—Shoulder strap
20—Upper quick release loop
21—Lower quick release loop
25—Side release buckle
26—Side release buckle catch end
27—Side release buckle hook end
28—Tether
29—Hook and loop attachment
30—Back strap
35—Chest strap
40—Belt
45—Side strap
50—Log carrier
52—Pouch
53—Triangular Strap
55—Clip
60—Large duffle bag
70—Small duffle bag

80—Extension strap
100—Weighted training log

DETAILED DESCRIPTION OF THE EMBODIMENTS

Figure 6:
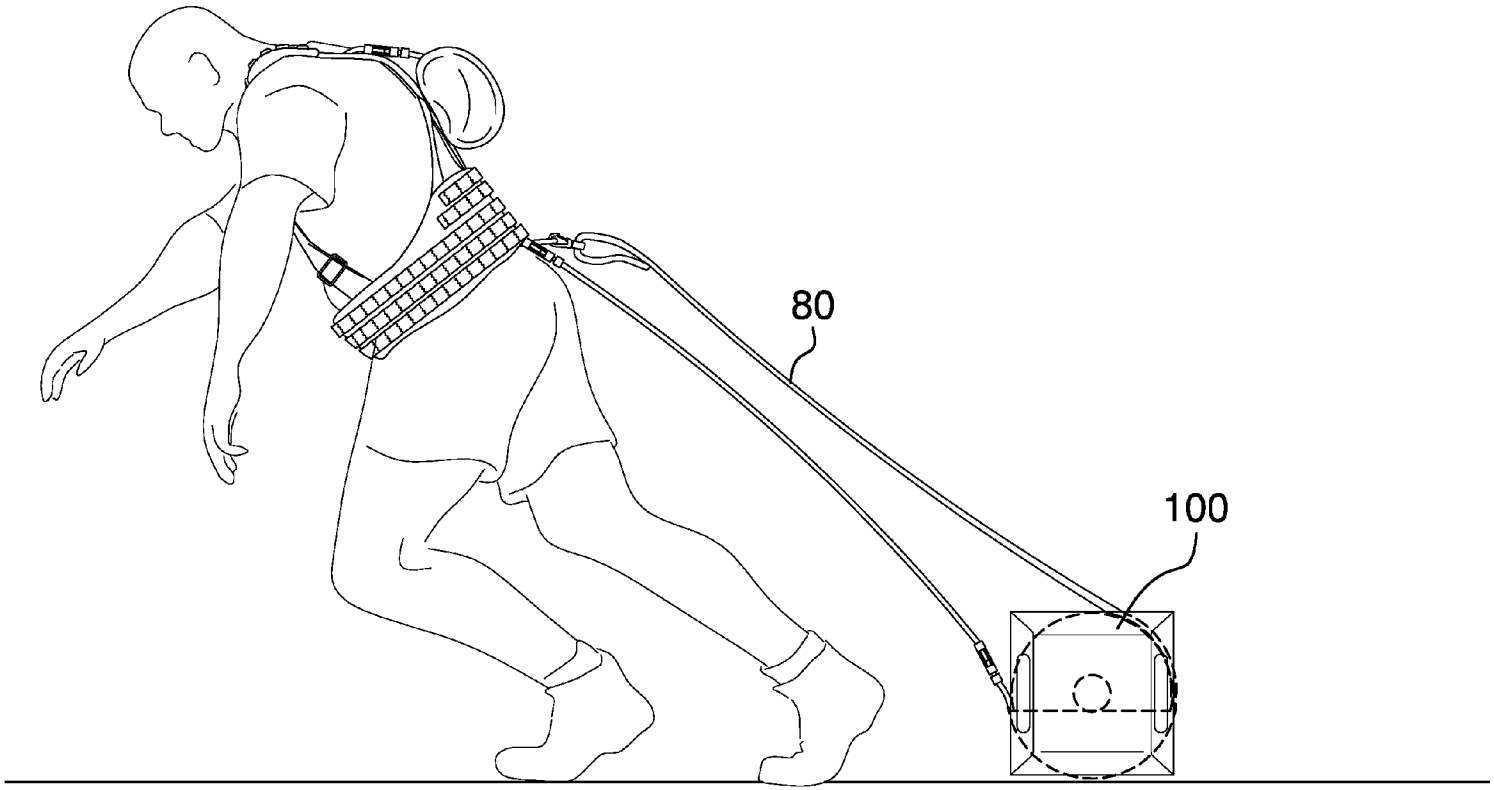
FIG. 6 is an in use view of the device, which is depicting a person wearing the harness and small duffle bag while dragging the weighted Olympic training log with the log carrier and an extension strap.

This device 1 is comprised of a harness system for carrying various objects at the same time. This harness system is specifically built for carrying and allowing a person to drag or carry a weighted Olympic log training device 100 such as depicted in FIG. 6. This device 1 is intended to allow the user to exercise intensely with a weighted Olympic training log in remote areas and over an extended period of time. The advent of cross-fit, weighted Olympic training logs have found their way into gyms.

The harness 5 provides various straps, buckles and connection points to allow a woman or man to drag or carry a weighted Olympic training log 100 behind her or his back. The harness 5 additionally allows for a duffle to bag to be carried with the weighted Olympic training log. Alternatively, if the user desires to carry a large duffle bag, the bag can be attached to side release buckle catch ends 26 on the harness 5.

The harness 5 is comprised of a shoulder strap 15, an upper quick release loop 20, a lower quick release loop 21, a plurality of side release buckle catch ends 26, a back strap 30, a chest strap 35, a belt 40, side straps 45, and a pouch attachment ladder system 10 or "PALS". The pouch attachment ladder system or PALS can also be used interchangeably with modular lightweight load-bearing equipment or "MOLLE" system 10.

The MOLLE system 10 provides rows of heavy duty nylon which are stitched on to the shoulder strap 15 and the belt 40 of the harness 5. This allows the user to place additional equipment on the harness 5 if desired. The inventor has anticipated the option of placing PALS or MOLLE on various other straps of the harness 5.

Figure 1:
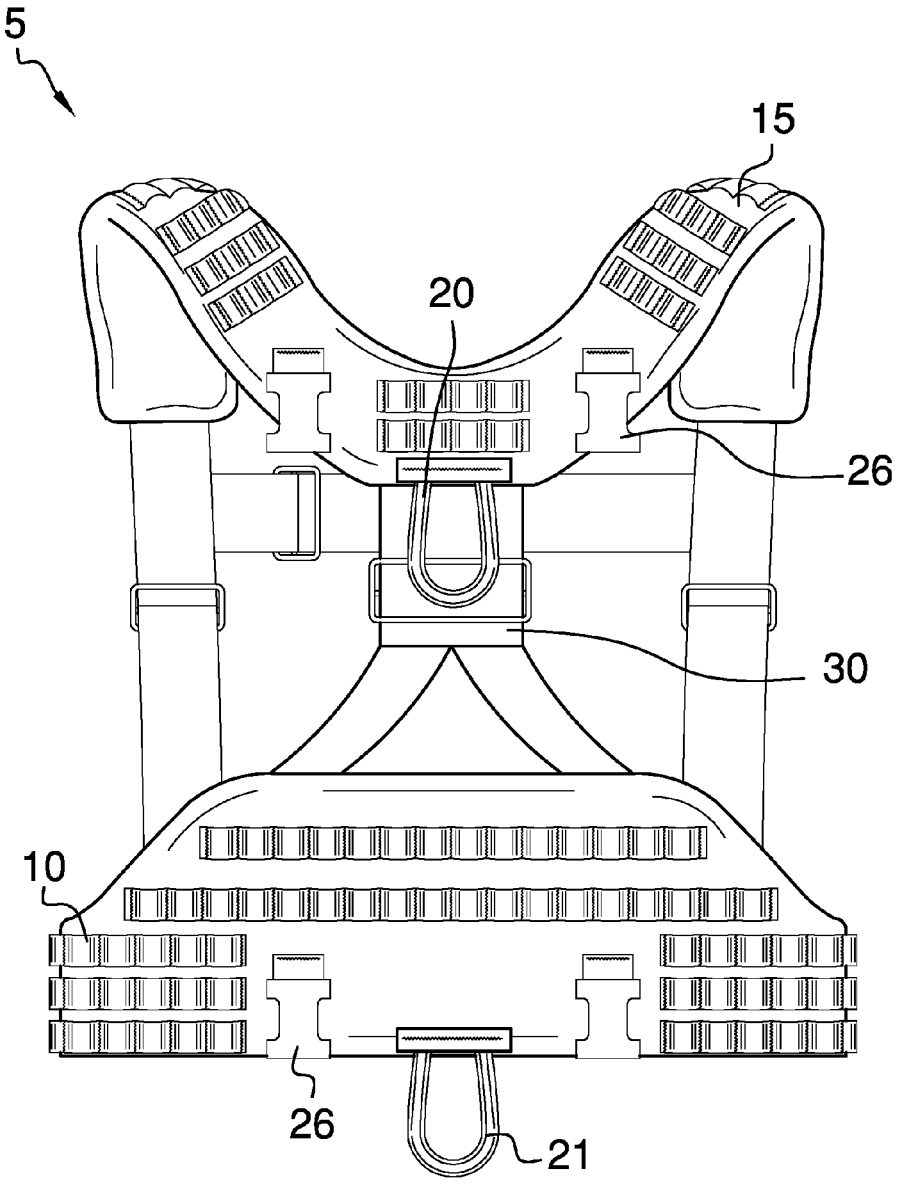
FIG. 1 is a back view of the harness depicting the back shoulder straps, the back tensioner strap, the back portion of the belt, four side release buckle catch ends, two quick release loops, and MOLLE on the back of the shoulder straps and the back area of the belt.

The shoulder strap 15 provides a first end and a second end. The middle of the strap 15 lays behind the user's neck and atop the person's back shoulders as seen in FIG. 1. The ends of the strap 15 then extend towards the front of the user and is to lay over the user's front shoulders and end at or just above the user's chest as seen in FIG. 2.

The harness also provides a first front side strap 45 and a second front side strap 45. Each side strap is attached to an end of the shoulder strap 15 and the heft 40. Each front side strap is independently adjustable.

Figure 2:
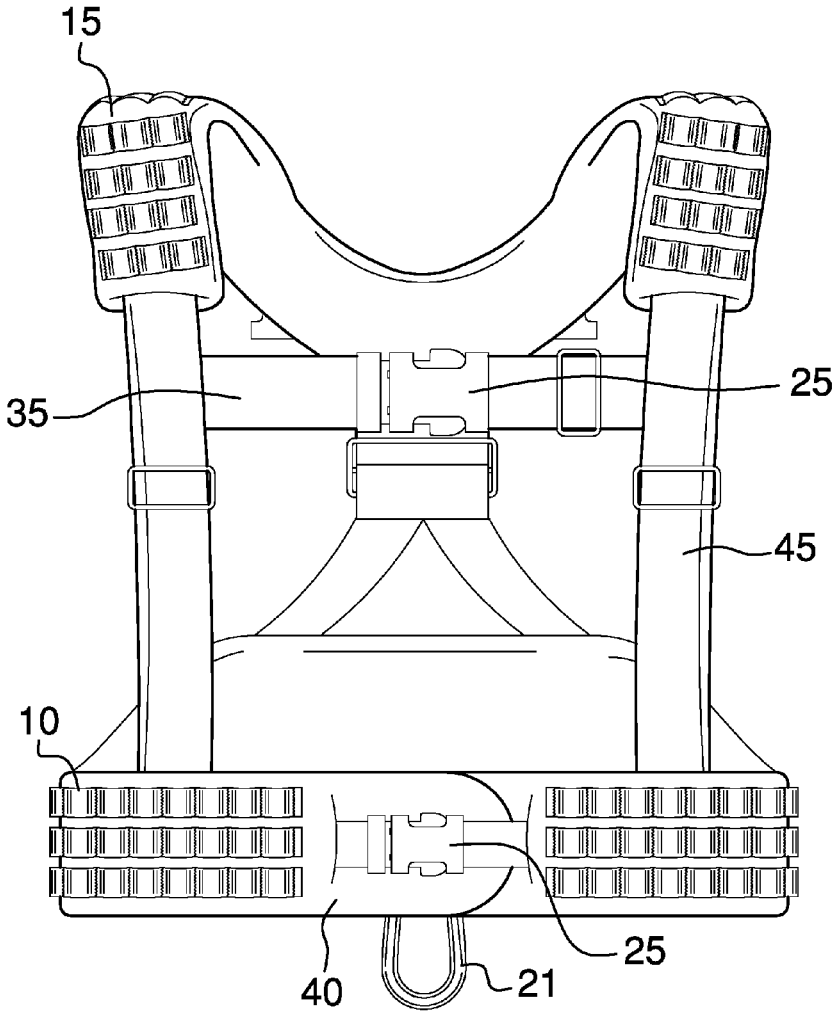
FIG. 2 is a front view of the harness depicting the front of the shoulder straps, the two side tensioner straps, the chest strap, which includes a tensioner and a side release buckle, the front portion of the belt, which includes a side release buckle, and MOLLE that continues from the back of the shoulder straps and belt to the front portions.

An adjustable chest strap 35 extends across the user's chest and is attached to both front side straps as shown in FIG. 2. The chest strap provides additional security by preventing one or both of the shoulder strap 15 ends from slipping over the side of the user's shoulder. A side release buckle 25 is provided to allow the user to more easily take off the harness when desired.

Figure 3:
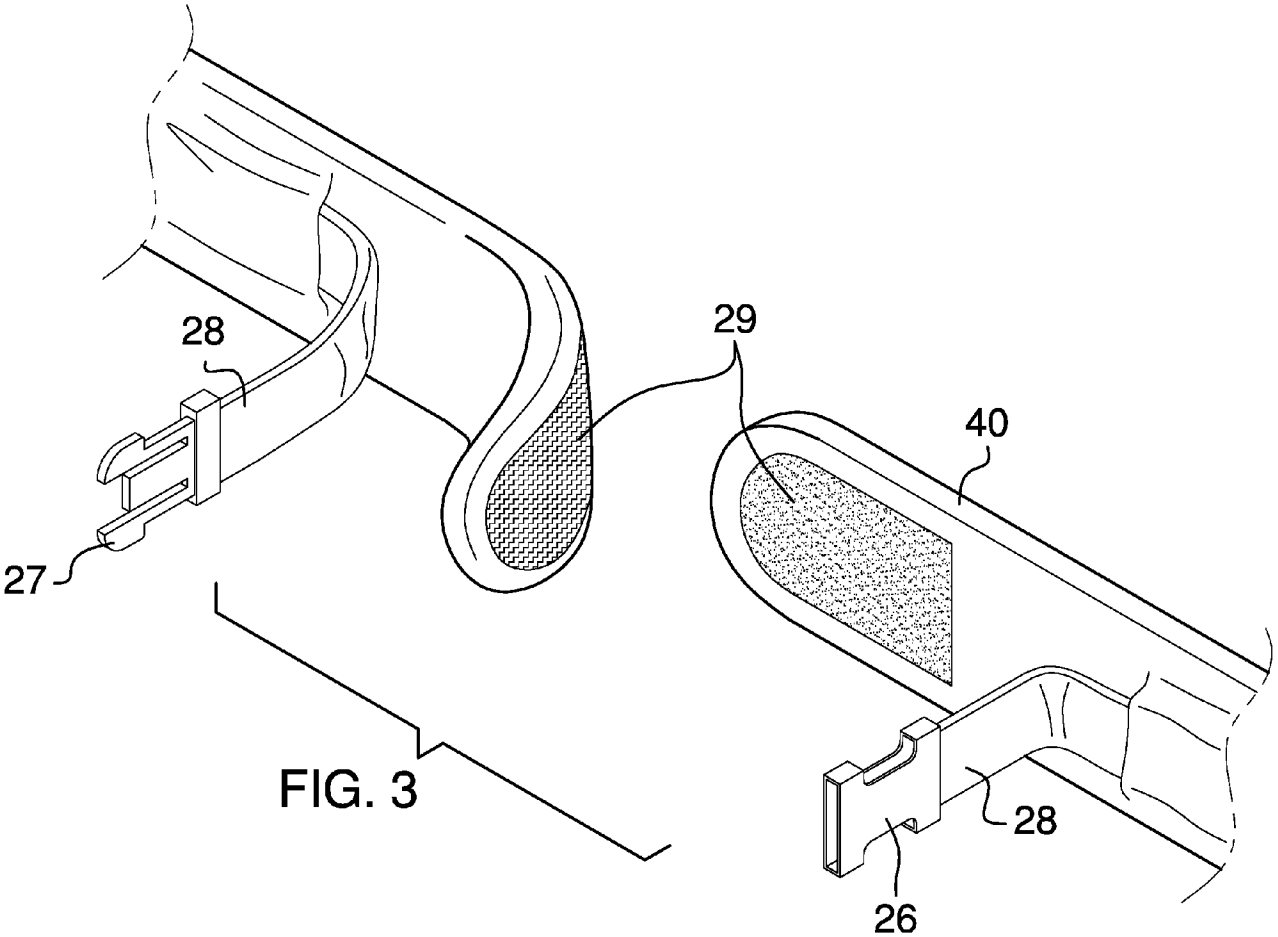
FIG. 3 is an isometric view of the front connecting region of the belt depicting where one side of the belt overlaps with its opposing side and attaches with a hook and loop assemblies and a side release buckle.

The belt 40 is worn by the user around her or his waist and connects just below or at the lower abdomen area of the individual as seen in FIG. 6. As seen in FIG. 3 the belt 40 connects initially with hook and loop assemblies 29. Then a tether 38 that lays within the belt connects over the hook and loop connection with a side release buckle catch end 25 and hook end 27. This multiple connection is important to provide a strong connection while still maintaining comfort during use. It is anticipated that the tether 28 may be adjustable. The belt 40 is padded for additional support and comfort when the individual is carrying heavy equipment or weight. The back region of the belt 40 is widened to extend up the user's lower back for lower back support as seen in FIG. 6.

An adjustable back strap 30 is provided on the back of the harness 5. The back strap has a first end and a second end. The first end of the back strap 30 is attached to the shoulder strap 15 and the second end is attached to the belt 40 as seen in FIG. 1. However, the second end of the back strap attaches to the belt in multiple areas. FIG. 1 shows the material of strap 30 dividing into two and attaching to the belt 40 at two separate areas.

The back of the harness 5 also provides a plurality of catch ends of a side release buckle 26 on the back of the shoulder strap 15 and the back of the belt 40. It is anticipated that alternatively the hook end of the side release buckle 27 could be used on the back of the harness 5 instead of the catch end 26. FIG. 1 depicts an upper set of catch ends 26 and a lower set of catch ends 26.

An upper quick release loop 20 and lower quick release loop 21 is also provided or the back side of the harness 5. The upper quick release loop 20 is attached at the middle of the shoulder strap 15 and lays over the back strap 30 as shown in FIG. 1. The lower quick release strap 21 is attached in the middle of the belt 40 as shown in FIG. 1

Second Embodiment

Figure 5:
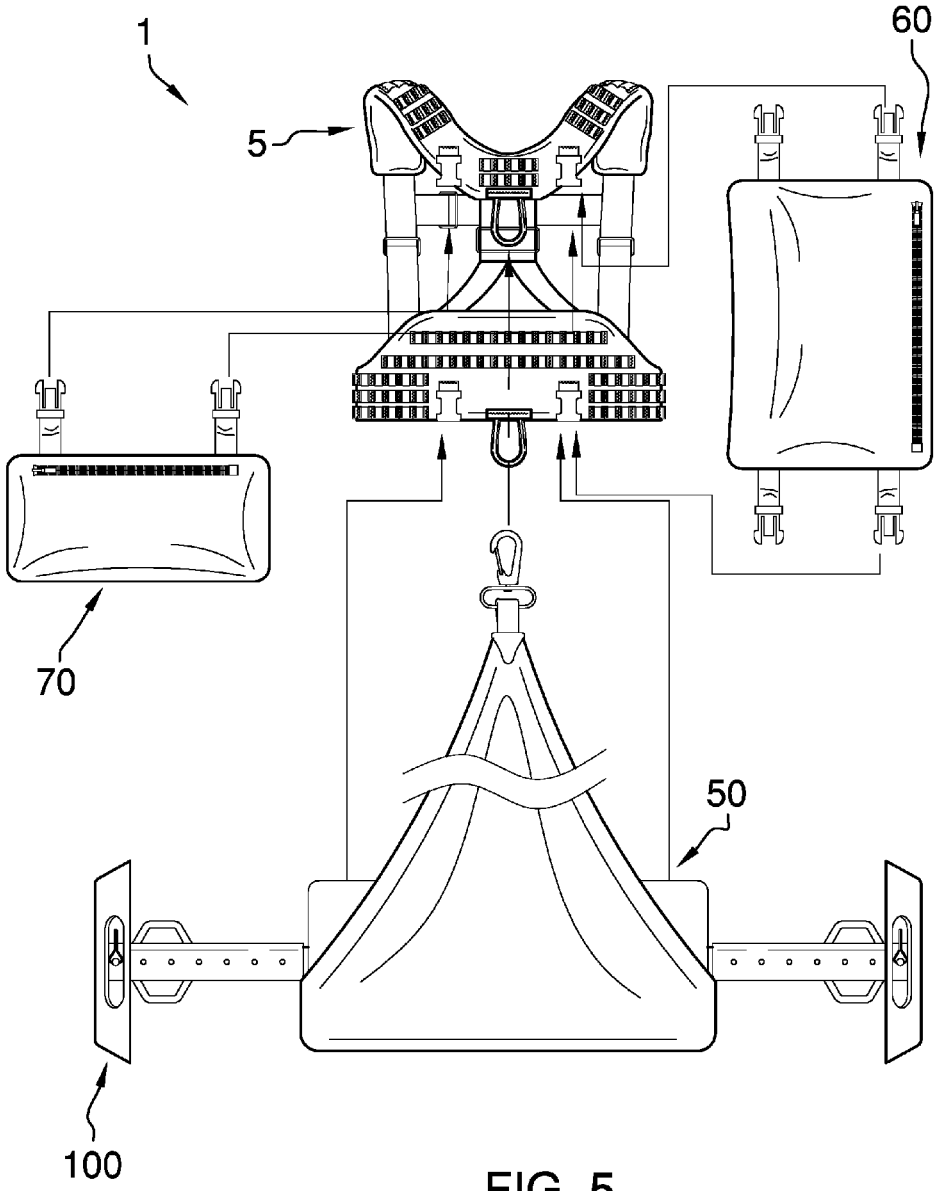
FIG. 5 is a schematic view of the device depicting that either the log carrier and a small duffle bag can be attached to the harness or the large duffle bag can be attached to the harness.

In the second embodiment the harness 5 of the first embodiment is provided with a duffle bag 60. The duffle bag 60 is attached to all four side release buckle catch ends 26 on the back side of the harness 5 as shown in FIG. 5. While the duffle bag 60 is attached in a vertical orientation, it is anticipated that the bag 60 could be attached in a horizontal orientation as well.

Furthermore, the duffle bag 60 is reversible and capable of carrying the harness 5 within it along with other equipment that the user desires to use. Due to the duffle bag 60 being reversible, the harness 5 can be taken out and worn by the user while never being detached from the bag 60. Accordingly, the harness can also be removed from the user and placed securely in the duffle bag 60 without being detached. This allows the user to easily carry the harness 5 and other equipment where she or he desires.

Third Embodiment

Figure 4:
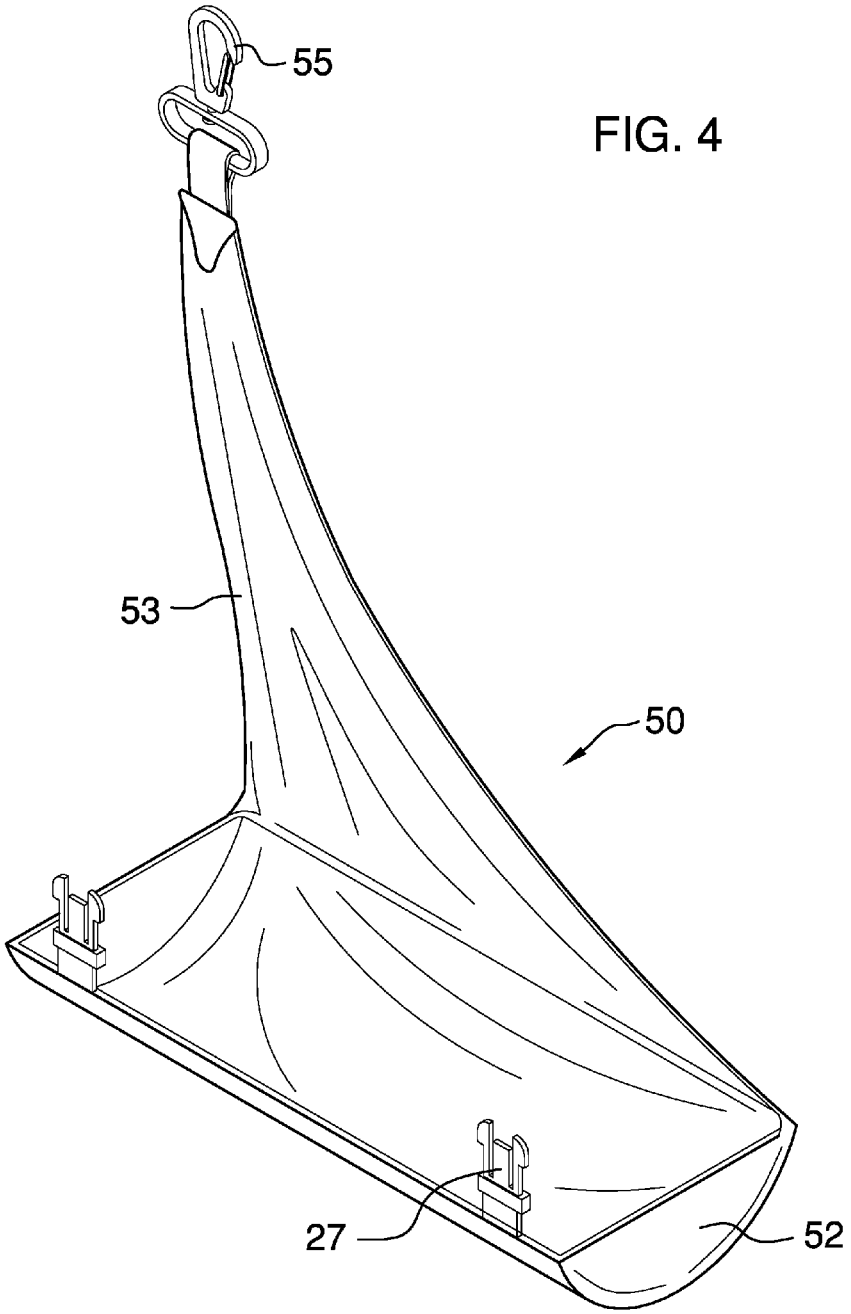
FIG. 4 is an isometric view of the log carrier depicting the sack that the drum of the log sits in, the log carrier strap, a clip, and two side release buckle hook ends.

In this third embodiment the harness 5 of the first embodiment is provided with a log carrier 50. The log carrier attaches to the back of the harness 5 and is comprised of a pouch 52, a triangular strap 53, a clip 55, and a plurality of hook end side release buckles 27 such as depicted in FIG. 4.

The pouch 52 is intended to hold the drum of the weighted Olympic training log 100. The clip 55 is intended to attach to the upper quick release loop 20 on the back side of the harness 5. Then the hook ends of the side release buckles are inserted into the lower catch ends attached to the back side of the belt 40. This helps with stabilizing the weighted Olympic training log 100 while being carried.

This embodiment also includes the use of an extension strap 80 that allows the individual to drag the weighted Olympic training log 100 on the ground such as depicted in FIG. 6. The extension strap has a first end and a second end. The first end attaches to the lower quick attach loop 21, wraps around the drum of the log 100, and the second end then attaches to the same quick attach loop 21. An alternative or additional extension strap 80 could also be used that works in connection with the log carrier 50 as shown in FIG. 6.

This third embodiment also allows for the use of an additional second duffle bag 70 that can be used with the log carrier 50. The second duffle bag 70 is intended to be attached to the two upper side release buckles on the back of the harness 5 as shown in FIG. 5 and FIG. 6. It is further anticipated that the duffle bag 70 can be reversible and house the harness 5 similarly to the duffle bag 60.

While the embodiments of the invention have been disclosed, certain modifications may be made by those skilled in the art to modify the invention without departing from the spirit of the invention.

The inventor claims:

1. A multifunctional training and workout harness which is comprised of:

a. a shoulder strap;
wherein the shoulder strap is padded;
wherein the shoulder strap has a first end and a second end;

b. a belt;
wherein the belt is padded;
wherein the belt is adjustable;

c. a back strap;
wherein the back strap has a first end and a second end;
wherein the first end of the back strap attaches to the shoulder strap;
wherein the second end of the back strap attaches to the belt;

d. a plurality of front side straps;
wherein there is a first front side strap and a second front side strap;
wherein the first front side strap has a first end and a second end;
wherein the second front side strap has a first end and a second end;
wherein the first end of said first front side strap attaches to the first end of the shoulder strap;
wherein the first end of said second front side strap attaches to the second end of the shoulder strap;

e. a chest strap;
wherein the chest strap has first end and a second end;
wherein the first end of said chest strap attaches to said first front side strap;
wherein the second end of said chest strap attaches to said second front side strap;

f. pouch attachment ladder system;
wherein the pouch attachment ladder system is provided on the shoulder strap;
wherein the pouch attachment ladder system is provided on the belt;

g. a plurality of side release buckles;
wherein the plurality of side release buckles are provided;
wherein the side release buckles have a catch end and a hook end;

h. a plurality of quick attachment loops;
wherein the plurality of quick attachment loops are provided on the harness.

2. The device as described in claim 1 wherein a duffle bag and a log carrier can both be attached to the device.

3. The device as described in claim 1 wherein a plurality of duffle bags can attach to the harness.

4. A multifunctional training and workout harness system which is comprised of:

a. a shoulder strap;
wherein the shoulder strap is padded;
wherein the shoulder strap has a first end and a second end;

b. a belt;
wherein the belt is padded;
wherein the belt is adjustable;

c. a back strap;
wherein the back strap has a first end and a second end;
wherein the first end of the back scrap attaches to the shoulder strap;
wherein the second end of the back strap attaches to the belt;

d. a plurality of front side straps;
wherein there is a first front side strap and a second front side strap;
wherein the first front side strap has a first end and a second end;
wherein the second front side strap has a first end and a second end;
wherein the first end of said first front side strap attaches to the first end of the shoulder strap;
wherein the first end of said second front side strap attaches to the second end of the shoulder strap;

e. a chest strap;
wherein the chest strap has a first end and a second end;
wherein the first end of said chest strap attaches to said first front side strap;
wherein the second end of said chest strap attaches to said second front side strap;

f. pouch attachment ladder system;
wherein the pouch attachment ladder system is provided on the shoulder strap;
wherein the pouch attachment ladder system is provided on the belt;

g. a plurality of side release buckles;
wherein the plurality of side release buckles are provided;
wherein the side release buckles have a catch end and a hook end;

h. a plurality of quick attachment loops;
wherein the plurality of quick attachment loops are provided on the harness;

i. a duffle bag;
wherein The duffle bag attaches to the harness.

5. The device as described in claim 4 wherein the duffle bag is reversible.

6. A multifunctional training and workout harness system which is comprised of:

a. a shoulder strap;
wherein the shoulder strap is padded;
wherein the shoulder strap has a first end and a second end;

b. a belt;
wherein the belt is padded;
wherein the belt is adjustable;

c. a back strap;
wherein the back strap has a first end and a second end;
wherein the first end of the back strap attaches to the shoulder strap;
wherein the second end of the back strap attaches to the belt;

d. plurality of front side straps;
wherein there is a first front side strap and a second front side strap;
wherein the first front side strap has a first end and a second end;
wherein the second front side strap has a first end and a second end;
wherein the first end of said first front side strap attaches to the first end of the shoulder strap;
wherein the first end of said second front side strap attaches to the second end of the shoulder strap;

e. a chest strap;

wherein the chest strap has a first end and a second end;

wherein the first end of said chest strap attaches to said first front side strap;

wherein the second end of said chest strap attaches to said second front side strap;

pouch attachment ladder system;

wherein the pouch attachment ladder system is provided on the shoulder strap;

wherein the pouch attachment ladder system is provided on the belt;

g. a plurality of side release buckles;

wherein the plurality of side release buckles are provided;

wherein the side release buckles have a catch end and a hook end;

h. a plurality of quick attachment loops;

wherein the plurality of quick attachment loops are provided on the harness;

i. a log carrier;

wherein the log carrier provides a pouch;

wherein the log carrier attaches to the harness.

7. The device as described in claim 6 wherein the log carrier can hold a weighted object.

8. The device as described in claim 6 wherein the carrier can assist with dragging a weighted object.

9. The device as described in claim 6 wherein the harness can attach to the log carrier and a duffle bag.

* * * * *